US005531160A

United States Patent [19]

Eigenmann

[11] Patent Number: 5,531,160

[45] Date of Patent: Jul. 2, 1996

[54] SINGLE-SHAFT FOUR-POINT PUNCH PRESS

[75] Inventor: Oskar Eigenmann, Arbon, Switzerland

[73] Assignee: Bruderer AG, Frasnacht, Switzerland

[21] Appl. No.: 374,618

[22] PCT Filed: Jun. 3, 1994

[86] PCT No.: PCT/CH94/00106

§ 371 Date: Mar. 7, 1995

§ 102(e) Date: Mar. 7, 1995

[87] PCT Pub. No.: WO94/29100

PCT Pub. Date: Dec. 22, 1994

[30] Foreign Application Priority Data

Jun. 4, 1993 [CH] Switzerland ..... 93108969.2

[51] Int. Cl.[6] ..... B30B 1/14

[52] U.S. Cl. ..... 100/258 R; 72/450; 83/615; 83/632; 100/282; 100/285

[58] Field of Search ..... 100/258 R, 282, 100/283, 285, 286; 72/450; 83/615, 632

[56] References Cited

U.S. PATENT DOCUMENTS

| | | | |
|---|---|---|---|
| 1,407,161 | 2/1922 | Klocke | 100/282 |
| 2,105,053 | 1/1938 | Patrick | 100/285 |
| 2,204,413 | 6/1940 | Hubbert | 100/285 |
| 2,302,132 | 11/1942 | MacMillin et al. | 100/258 R |
| 2,375,398 | 5/1945 | Wilkins | 100/293 |
| 4,013,003 | 3/1977 | Finsterwalder et al. | 100/285 |
| 4,638,704 | 1/1987 | Wanibuchi et al. | 83/628 |
| 4,817,456 | 4/1989 | Imanishi et al. | 100/282 |
| 4,873,923 | 10/1989 | Manning | 100/258 R |
| 5,317,893 | 6/1994 | Eigenmann et al. | 100/282 |

FOREIGN PATENT DOCUMENTS 0395964 11/1990 European Pat. Off. .

*Primary Examiner*—Stephen F. Gerrity
*Attorney, Agent, or Firm*—Ladas & Parry

[57] ABSTRACT

The push rods (16, 17) are connected via ball-and-socket joints (42–45) to the ram (3). The sockets (44, 45) are located within the push rods (16, 17) and the balls (42, 43) are located above the ram (3) and mounted to same. Thus, in case of off center loadings of the ram (3) no bending moments are transmitted to the push rods (16, 17). The entire bottom side of the ram (3) is available for the receipt of connecting members for the mounting of a tool to the ram.

6 Claims, 4 Drawing Sheets

SINGLE-SHAFT FOUR-POINT PUNCH PRESS

The invention relates to a single-shaft four-point punch press with a machine frame; an eccentric shaft supported for rotation in the machine frame; a ram guided for a rectilinear reciprocating movement in the machine frame; an arrangement of rods with rod members which are drivingly connected to the eccentric shaft;

a lever arrangement having four single lever units arranged separate from each other, whereby every lever unit is pivotally mounted individually and independent from the other lever units at a first point to the rod members and pivotally supported at the machine frame at a second point, and includes a respective further pivot point located remote from these two points;

four push rods extending parallel to each other, of which each one is pivotally mounted at one end to one of the further pivot points and at the other end to the ram.

The off-center loading of the tools, specifically of the upper tool in such punch presses causes various difficulties and drawbacks. The allowable loading of the tools decreases for a given machine frame size considerably towards the edge areas of the tools and reaches sometimes the value zero. Among others, it is the bearing areas such as, for instance, between push rods and rams and also between push rods and driving members pivotally mounted thereto which are subject to a high wear and increased friction in case of off-center loadings of the tools. Furthermore, an increased wear occurs also at the push rods and at the guides for the ram and in the tool. Additionally, off center loadings cause tilting movements and elastic deformations such as, for instance, a bending of elongated structural members of the punch press and accordingly to a loss of the precision of manufacture of the punched articles produced.

In the European patent application no. 92 116 064.4 a punch press is disclosed which includes single lever units arranged separate from each other, whereby every lever unit is pivotally mounted to the rod members and machine frame, respectively, independently from the other lever units, whereby every respective lever unit is pivotally mounted to a push rod. In case of specifically this punch press, but also of other punch presses, the tool can be mounted to the ram only at such areas which are located at the edge of the tool, i.e. the connecting members, e.g. threaded bolts, by means of which the tool is mounted to the ram, display a large distance from each other. Therefore, due to this unfavorable supporting of the tool it is possible that deformations of the tool occur due to its weight and also due to thermal expansions, which can negatively influence the precision of the articles produced by such punch press, specifically in case of tools having rather large longitudinal dimensions. Furthermore, off center forces laterally relative to the direction of feed of the web are not transmitted at such punch presses without any moments to the pivotal points of the push rods and to the lever units. It is possible that bending moments occur in the push rods and in the pivot pins of the pivot joints.

Here, the invention will provide a remedy. The invention such as defined in the claims solves the object to provide a single-shaft four-point punch press, in which the rods are mounted via ball-and-socket joints to the ram.

The advantages gained by the invention are mainly to be seen, in that in case of off center loadings of the tool no moments are transmitted to the areas where the push rods are pivotally mounted to the lever units. Accordingly, a smaller wear occurs at bearing and connection areas of the press and a decrease of friction forces. Furthermore, although the pivotal points of ball-and-socket joints are located above the ram, the punch press can be kept rather small, such that spring elastic properties of the punch press and the thermal stability of the punch press can be maintained at low levels.

In the following, the invention will be explained more in detail based on the drawings illustrating one embodiment only.

The eccentric shaft 2 of the single-shaft four-point punch press is supported for rotation in the machine frame 1 by roller bearings 22 and 23. The eccentric shaft 2 is coupled via a coupling-/brake apparatus to a flywheel, which is drivingly connected via a belt drive to an electromotor. Mentioned structural members are generally known and customarily present at punch presses such that a detailed description thereof is not necessary.

Figure 2:
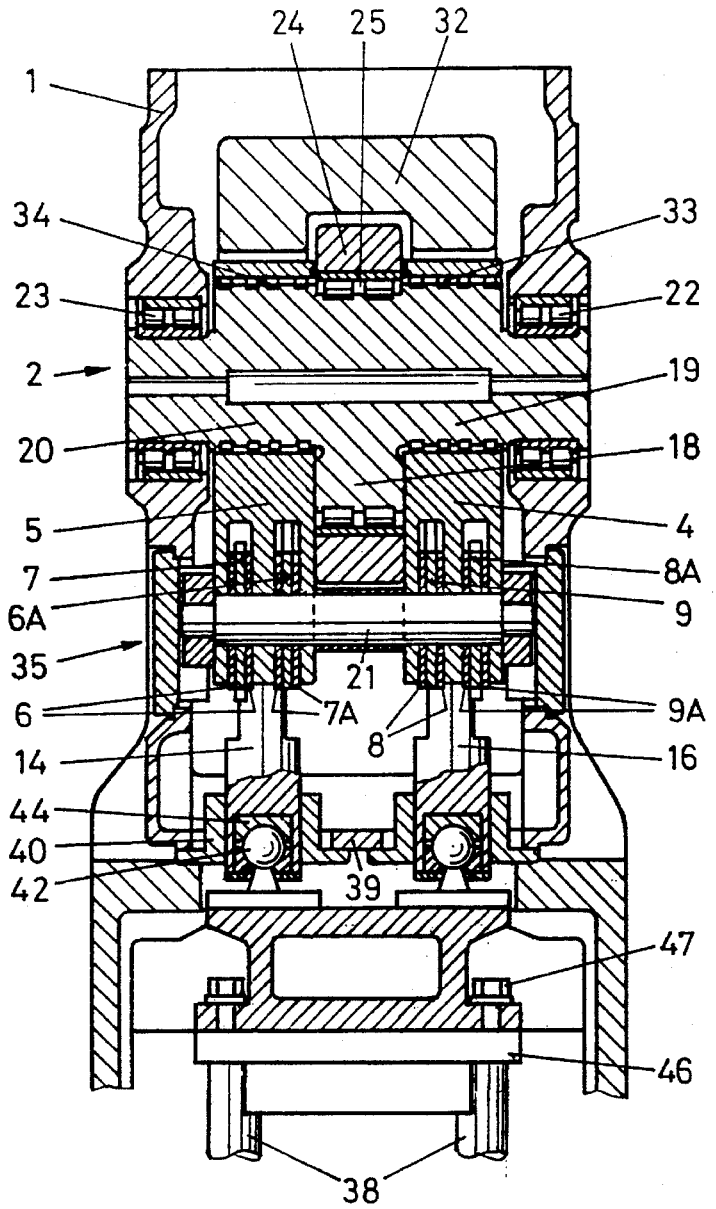
FIG. 2 is a section along line II—II of FIG. 1.

The eccentric shaft 2 includes a center eccentric portion 18 and at both sides of this center eccentric portion 18 one respective further eccentric portion 19 and 20, respectively (see FIG. 2). A yoke-shaped balancing weight member 24 is supported via roller bearings 25 on the center eccentric portion 18. This balancing weight member 24 serves for balancing in operation of the punch press the rotating mass forces of the press. At the lateral ends of this balancing weight member levers 26 and 27, respectively, are pivotally mounted thereto by means of pivot pins 28 and 29, respectively, which in turn are pivotally mounted via further pivot pins 30 and 31, respectively, to the balancing weight member 32 for a balancing of the oscillating mass forces. This design is disclosed in the U.S. Pat. No. 4,757,734 of the same applicant, which disclosure is incorporated in this specification by reference thereto.

Figure 2A:
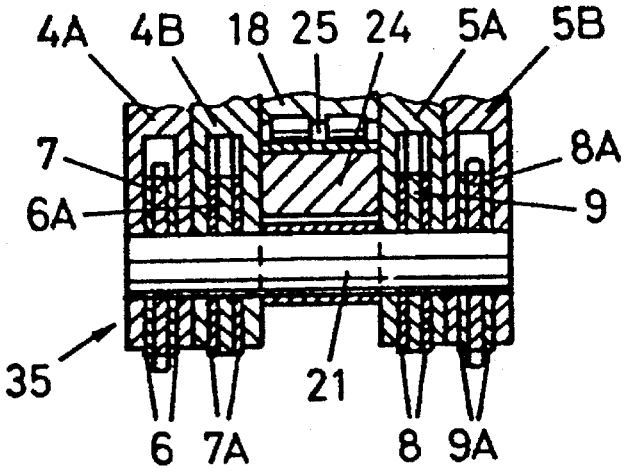
FIG. 2A is a variant of the design of the push rod.

On the further eccentric portions 19 and 20, respectively, located at both sides of the center eccentric portion 18 a respective rod member 4 and 5, respectively, is supported via roller bearings 33 and 34, respectively. According to the embodiment illustrated in FIG. 2 these rod members 4 and 5, respectively, are shaped at the lower end in form of a fork having three prongs. A bolt 21 extends through the prongs of this fork, i.e. the walls of the forked rod members 4 and 5, respectively. FIG. 2A illustrates a further embodiment which will be described in detail further below.

The punch press includes four lever units 6, 6A, and 7, 7A and 8, 8A, and 9, 9A, respectively, which lever units form the entire lever apparatus of the punch press and are pivotally mounted at one of their ends to this bolt 21, which, therefore, is common to all lever units. Mentioned ends are identified in the figures generally by the reference numeral 35.

At their opposite ends, which are generally identified in the drawings by the reference numeral 36, the lever units are supported in accordance with the designed embodiment via threaded spindles 37 at the machine frame 1. The adjusting of the height position of the ends 36 of the lever units and accordingly of the ram 3 of the punch press is accomplished by a rotating of these threaded spindles. Details of this design for the adjusting of the height of the tool carrier are disclosed in the U.S. Pat. No. 5,052,257, which disclosure is incorporated here by reference.

Now, the lever arrangement of the punch press will be explained. Attention is drawn hereto specifically to FIG. 3. Each rod member 4 and 5, respectively, is allocated to two single arm lever units, which are supported at one end on mentioned bolt 21.

The lever units are composed merely due to structural reasons of lever sections located side by side of each other.

Thereby, the lever unit having the lever portions 8, 8A and the lever unit having the lever portions 9, 9A are allocated to the rod member 4. Accordingly, these lever units are arranged pair-wise.

In other words, the lever units having the lever portions 8, 8A and 9, 9A form together a lever pair driven by the rod member 4.

The lever unit having the lever portions 6, 6A and the lever unit having the lever portions 7, 7A are allocated to the rod member 5. Also these lever units form a lever pair and are composed due to structural reasons of mentioned lever portions.

All individual lever portions 6, 6A, 7, 7A, 8, 8A, 9, 9A forming together the entire lever assembly are single-arm levers which are supported at one their ends on the bolt 21 common to all and at the other end on the threaded spindle 37 and accordingly indirectly on the machine frame 1.

Figure 3:
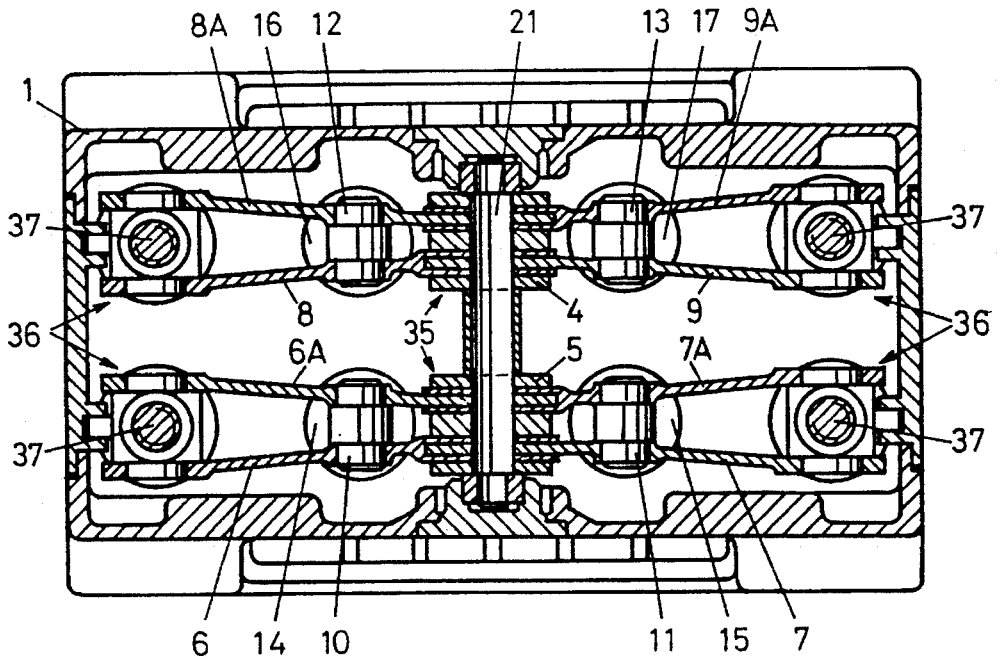
FIG. 3 is a section along line III—III of FIG. 1.

Specifically FIG. 3 and also FIG. 2 disclose that these lever portions engage each other on the bolt 21 at their ends in a fork-like manner. The lever portion 9A includes a fork-like end, and the lever portion 8A extends into the interstice between the prongs of the fork. The lever portion 8 is forked and receives in the fork the lever portion 9. Furthermore, the lever portions 7A and 6 are forked and receive the lever portions 6A and 7, respectively.

Every lever unit includes a further pivotal point located between its ends 35, 36 having a pivot pin 10, 11, 12 and 13, respectively.

The lever unit with the lever portions 6, 6A includes the pivot pin 10, the lever unit with the lever portions 8, 8A includes the pivot pin 11, the lever unit with the lever portions 7, 7A includes the pivot pin 12 and the lever unit with the lever portions 9, 9A includes the pivot pin 13.

The push rod 14 is pivotally mounted to the pivot pin 10, the push rod 15 is pivotally mounted to the pivot pin 11, the push rod 16 is pivotally mounted to the pivot pin 12 and finally the push rod 17 is pivotally mounted to the pivot pin 13. Accordingly, this single-shaft four-point punch press includes four push rods. At their lower ends these push rods 14, 15, 16, 17 are finally pivotally connected to the ram 3. The ram 3 includes four guiding columns 38, by means of which it is guided in the machine frame 1.

FIG. 2A illustrates a variant, in which both rod members 4, 5 are divided; accordingly four single rod members 4A, 4B and 5A, 5B are present. Thus, one lever pair, e.g. the levers 6 and 7 of FIG. 3, is allocated to one respective of these rod members.

The push rods 14–17 extend through the bottom close-off plate 39 of the machine frame 1, which plate 39 closes the inner space of the machine frame 1 off against the area of the ram 3 of the punch press. The push rods 14–17 extend thereby through movable seals 40, 41, which are inserted in the bottom closed-off plate 39.

Figure 1:
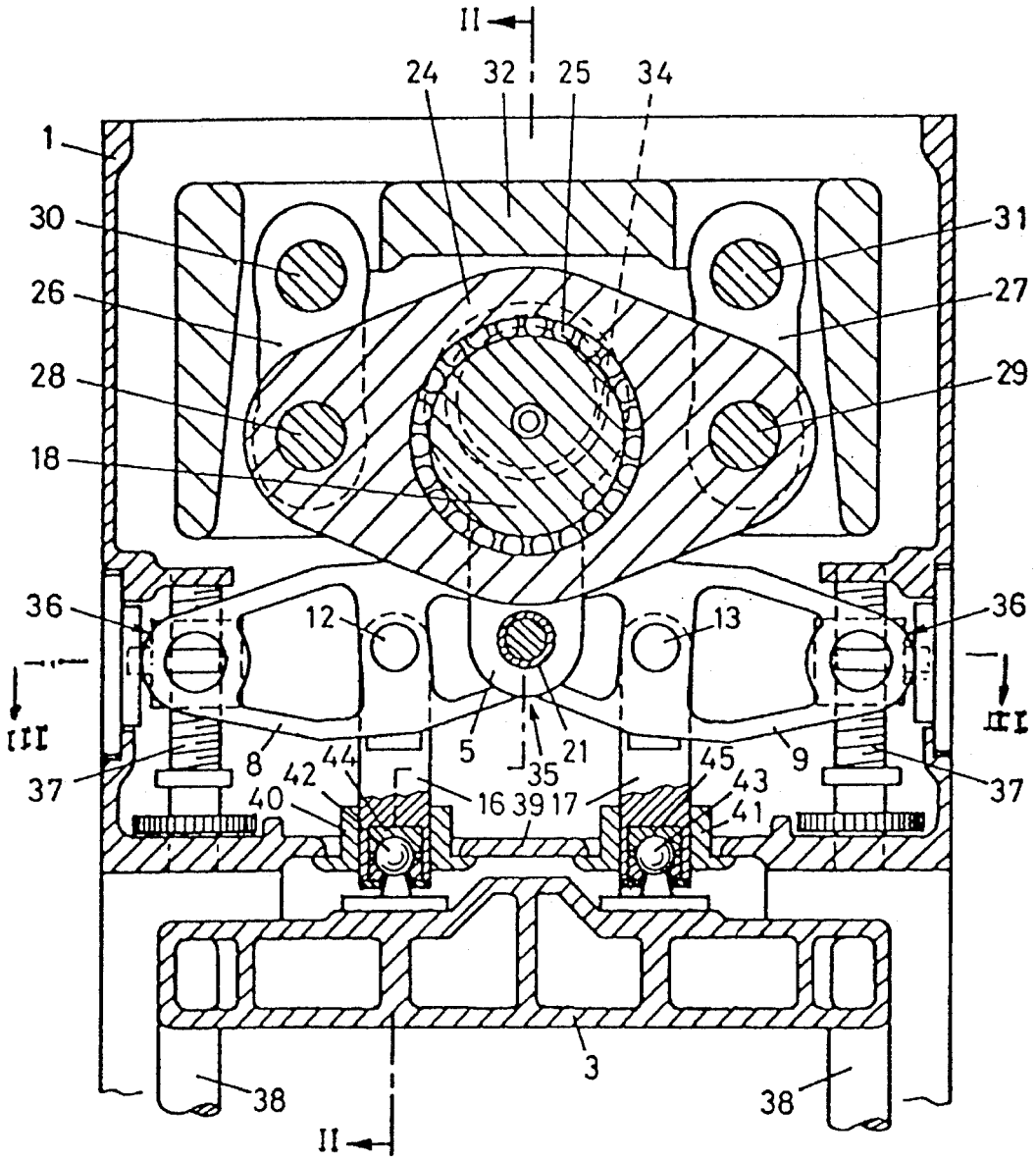
FIG. 1 is a vertical section through a single-shaft four-point punch press.

Now, the push rods 14–17 are connected via ball-and-socket joints having balls 42, 43 and sockets 44, 45 to the ram 3. The sockets 44, 45 are thereby mounted in the push rods at the upper side of the ram. Due to this ball-and-socket joints it is not possible that bending moments are produced in the push rods 14–17, and no bending moments can be transmitted, respectively, onto the push rods 14–17 in case of off center loadings of a tool mounted to the ram 3 and independently from the location where such off center loadings occur. Furthermore, because the fulcrum points of the ball-and-socket joints are located above the ram 3, the entire bottom side of the ram 3 is available for the receipt of connecting members, by means of which the tool 46 is mounted e.g. by means of threaded bolts 47 to the ram 3. FIGS. 1 and 2 disclose, furthermore, that in the (illustrated) upper dead center position of the ram 3 the fulcrum points of the ball-and-socket joints 42, 44 and 43, 45 are located in the space enclosed by the movable seals 40, 41. Due to this fact the total height of the punch press can be kept to a minimal measure although the joints between the ram 3 and the push rods are located above the ram 3, such the spring elastic characteristics of the entire punch press can be held at an extremely low value and also that the thermal stability of the punch press is not negatively influenced by mentioned location of the joints.

I claim:

1. A single-shaft four-point punch press having a machine frame, said machine frame having a bottom close-off plate;

an eccentric shaft supported for rotation in said machine frame;

a ram guided for a rectilinear reciprocating movement in said machine frame;

an arrangement of rod members, which rod members are drivingly connected to said eccentric shaft;

an arrangement of levers having four lever units arranged separate from each other, whereby every lever unit is pivotally mounted individually and independent from the other lever units at a first point to rod members and pivotally supported at the machine frame at a second point, and includes a further pivot point located remote from said first and second points;

four push rods extending parallel to each other, of which each push rod is pivotally mounted at one of its ends to one of said further pivot points and at its other end to said ram;

said punch press comprising ball-and-socket joints arranged in such a manner that each push rod is pivotally mounted via one ball-and-socket joint to said ram, in which:

said ram is movable between an upper dead center position and a lower dead center position, wherein the fulcrum point of each ball-and-socket joint is located inside of the respective push rod and each push rod extends through a movable seal mounted to said bottom close-off plate of the machine frame, by means of which seal the inner space of the machine frame is sealed against the area of the ram in the punch press; and at the upper dead center position of the ram, each respective fulcrum point of the ball-and-socket joints is located in the area enclosed by the respective seal.

2. The single-shaft four-point punch press of claim 1, in which the socket of each respective ball-and-socket joint is located within a respective push rod and the ball thereof is rigidly mounted to said ram.

3. The single-shaft four-point punch press of claim 2, in which said eccentric shaft comprises a center eccentric portion and at both its sides an adjacent further eccentric portion;

said punch press includes means for balancing mass forces occurring in operation of the punch press, which mass forces balancing means is drivingly connected to said center eccentric portion;

respective rod members of said arrangement of rod members are supported on a respective further eccentric portion;

said lever units of said arrangement of levers form pairs of single arm levers, each having a first and a second, opposite end, whereby each single arm lever is pivotally mounted at its first end via a bolt common to all to a respective rod member, and at its second end to said machine frame, and in which said further pivot points are located between said first and said second ends;

said push rods are pivotally mounted at one of their ends to one of said further pivot points of said pairs of single arm levers, and at the other of their ends to said ram, such that each rod member is simultaneously pivotally mounted to two pairs of single arm levers, of which every one is in turn mounted to one of said push rods.

4. The single-shaft four-point punch press of claim 3, in which every two of said single arm lever pairs are arranged side-by-side and their further pivot points are located at the same distance from said bolt common to all, such that said push rods determine the corners of a rectangular square.

5. The single-shaft four-point punch press of claim 4, in which each rod member has a head in form of a fork having three prongs, further in which each lever unit consists of two lever portions located side-by-side and each having a first end and a second end, whereby the first ends of the respective lever portions are supported in the respective interstice between the side walls of the prongs on the bolt common to all.

6. The single-shaft four-point punch press of claim 4, in which each rod member includes two rods located side-by-side, each having a forked head, further in which each lever unit consists of two lever portions located side-by-side and each having a first end and a second end, whereby the first ends of the respective lever portions are supported in the respective interstice between the side walls of the prongs on the bolt common to all, such that the arrangement of rod members comprises four rods.

* * * * *